US011129250B2

(12) United States Patent
Vissenberg et al.

(10) Patent No.: US 11,129,250 B2
(45) Date of Patent: Sep. 21, 2021

(54) ARTIFICIAL SUNLIGHT LUMINAIRE

(71) Applicant: SIGNIFY HOLDING B.V., Eindhoven (NL)

(72) Inventors: Michel Cornelis Josephus Marie Vissenberg, Eindhoven (NL); Aldegonda Lucia Weijers, Eindhoven (NL); Ronald Cornelis De Gier, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 469 days.

(21) Appl. No.: 16/074,328

(22) PCT Filed: Feb. 14, 2017

(86) PCT No.: PCT/EP2017/053220

§ 371 (c)(1),
(2) Date: Jul. 31, 2018

(87) PCT Pub. No.: WO2017/144303

PCT Pub. Date: Aug. 31, 2017

(65) Prior Publication Data

US 2021/0195706 A1 Jun. 24, 2021

(30) Foreign Application Priority Data

Feb. 23, 2016 (EP) ..... 16156841

(51) Int. Cl.
*H05B 45/20* (2020.01)
*F21S 8/04* (2006.01)
(Continued)

(52) U.S. Cl.
CPC ..... *H05B 45/20* (2020.01); *F21S 8/04* (2013.01); *F21V 14/02* (2013.01); *F21Y 2113/10* (2016.08); *F21Y 2115/10* (2016.08)

(58) Field of Classification Search
None
See application file for complete search history.

(56) References Cited

U.S. PATENT DOCUMENTS 5,803,579 A * 9/1998 Turnbull ..... F21S 41/143 362/516
2005/0195599 A1 9/2005 Marka
(Continued)

FOREIGN PATENT DOCUMENTS

EP 2106198 A1 11/2009
EP 2732700 A1 5/2014
(Continued)

OTHER PUBLICATIONS

E.F. Schubert, Light-Emitting diodes (Cambridge Univ. press), www.LightEmittingDiodes.org, Fig. 18.4.

*Primary Examiner* — Crystal L Hammond
(74) *Attorney, Agent, or Firm* — Daniel J. Piotrowski

(57) ABSTRACT

The invention provides a lighting system (1) with at least two subsets (SS1, AS1) of light sources, wherein one or more first subsets (SS1, SS2, . . . ) provide first light (111) mimicking the solar light (during the day) and with the first light (111) having a variable direction, and wherein one or more second subsets (AS1, . . . ) provide second light (211) mimicking the sky (without the sun, as the sun is provided by the first subset(s)) 5 (during the day). Especially, the color and/or color temperature of the first light (111) is variable, in addition the variability in direction. The lighting system may further comprise a control system (20) configured to control the color and intensity of the first light and/or second light.

14 Claims, 7 Drawing Sheets

(51) Int. Cl.

| | |
|---|---|
| ***F21V 14/02*** | (2006.01) |
| ***F21Y 115/10*** | (2016.01) |
| ***F21Y 113/10*** | (2016.01) |

(56) References Cited

U.S. PATENT DOCUMENTS

| | | | | |
|---|---|---|---|---|
| 2007/0139920 | A1 | 6/2007 | Van De Ven et al. | |
| 2009/0073540 | A1* | 3/2009 | Kothari | G02B 26/001 359/291 |
| 2009/0207604 | A1* | 8/2009 | Robotham | F21V 29/75 362/230 |
| 2011/0164429 | A1* | 7/2011 | Heym | F21K 9/69 362/471 |
| 2013/0120688 | A1* | 5/2013 | Chao | F21V 9/45 349/62 |
| 2014/0160719 | A1 | 6/2014 | Van Boven et al. | |
| 2015/0023011 | A1* | 1/2015 | Takei | F21K 9/64 362/231 |
| 2015/0300617 | A1 | 10/2015 | Katona et al. | |
| 2016/0023017 | A1 | 1/2016 | Moore-Ede et al. | |
| 2016/0298813 | A1* | 10/2016 | Jurik | F21V 5/008 |

FOREIGN PATENT DOCUMENTS

| | | | |
|---|---|---|---|
| JP | 2015065036 | A | 4/2015 |
| WO | WO2013050918 | A1 | 4/2013 |
| WO | WO2015049146 | A1 | 10/2013 |
| WO | WO2014076656 | A1 | 5/2014 |
| WO | WO2015057055 | A2 | 4/2015 |
| WO | WO2015104164 | A1 | 7/2015 |
| WO | WO2015128205 | A1 | 9/2015 |

* cited by examiner

ARTIFICIAL SUNLIGHT LUMINAIRE

CROSS-REFERENCE TO PRIOR APPLICATIONS

This application is the U.S. National Phase application under 35 U.S.C. § 371 of International Application No. PCT/EP2017/053220, filed on Feb. 14, 2017, which claims the benefit of European Patent Application No. 16156841.5, filed on Feb. 23, 2016. These applications are hereby incorporated by reference herein.

FIELD OF THE INVENTION

The invention relates to a lighting system. The invention also relates to the use of such lighting system.

BACKGROUND OF THE INVENTION

Artificial daylight sources are known in the art. WO2013/050918, for instance, describes a light emitting arrangement, comprising a light source comprising a light out-coupling surface, adapted to emit light of a first wavelength range, and a wavelength converting member capable of converting light of said wavelength range into light of a second wavelength range, the wavelength converting member being arranged at a distance from the light source and centrally aligned with the light out-coupling surface light source, and being arranged to receive and partially convert a central portion of the light emitted by the light source while allowing light emitted by the light source in a peripheral direction to pass beside the wavelength converting member. In this way the light emitting arrangement provides light of first color in a normal direction and a light of another non-converted color in a peripheral direction, which may give a more realistic impression of daylight.

US2005/195599A1 discloses an operating lamp for illumination of an illumination field includes a plurality of individual light modules optionally of variable, different color and pivotably connected together to form a light source.

SUMMARY OF THE INVENTION

A way to mimic daylight is found in light therapy lamps that may create a lot of light. These are often used to alleviate seasonal depression or sleeping problems. More advanced artificial daylight lamps are the sunrise simulators that are applied as an alarm clock. While these products may already be effective, the illusion of daylight may be enhanced further by changing the direction of the light (daylight comes from above, not from a table) and by adding visual content. A high-output beamer may also be used to project a light pattern on the ceiling. However, such artificial daylighting ceilings with dynamic visual content may be bulky and may be relative very expensive. There are several disadvantages to the daylighting systems known in the art that effectively block the use of these systems in e.g. consumer homes.

Hence, it is an aspect of the invention to provide an alternative lighting system, which preferably further at least partly obviates one or more of above-described drawbacks, and which is especially configured to mimic a sky (including sunrise and sunset). Thereto the lighting system according to the invention comprises:

a. at least two first subsets of first light sources configured to provide first light comprising two or more first light beams in at least two or more different first directions, wherein the two or more first light beams have a color selected from the group consisting of yellow, orange, red, and white with a first correlated color temperature;

b. one or more second subsets of one or more second light sources configured to provide second light comprising one or more second light beams in one or more second directions, wherein the one or more second light beams have a color selected from the group consisting of purple, violet, blue and white light having a second correlated color temperature, wherein one or more of the color and correlated color temperature of the first light is variable, wherein the intensity of the first light is variable, and wherein one or more of the color and correlated color temperature of the second light is variable, wherein the intensity of the second light is variable; wherein one or more of said first light and said second light have a variable directionality, and wherein the first light has a v' value of at least 0.47 according to CIE 1976 and wherein the second light has a lower v' value;

c. a control system configured to control (i) one or more of (a) intensities of the two or more first light beams and (b) one or more of colors and first correlated color temperatures of the two or more first light beams, and configured to control (ii) one or more of (c) one or more intensities of the one or more second light beams and (d) one or more of colors and second correlated color temperatures of the one or more second light beams;

wherein the lighting system is configured to provide one or more of (a) said first light having a variable angular distribution of one or more of intensity, color, and correlated color temperature, and (b) said second light comprising one or more of said one or more second light beams.

Especially, the invention provides a lighting system with at least two subsets of light sources, wherein one or more first subsets provide first light mimicking the solar light (during the day) and with the first light especially having a variable direction, and wherein one or more second subsets provide second light mimicking the sky (without the sun, as the sun is provided by the first subset(s)) (during the day).

Especially, the color and/or color temperature of the first light is variable, in addition to the variability in direction. Yet more especially, the first light may have a (variable) color selected from the group consisting of yellow, orange, red, and white light having a (variable) correlated color temperature of for instance less than 6000 K, such as equal to or less than 5500 K. Further, especially the color and/or color temperature of the second light is variable. Yet more especially, the second light may have a (variable) color selected from the group consisting of purple, violet, blue and white light having a (variable) correlated color temperature (CCT) of more than 5500, such as more than 6000 K.

Especially, during operation in modes of operation where both the first light and the second light are provided, they have different color temperatures. In embodiments, there may also be color gradients. In such embodiments, especially the range of color temperatures provided by the first light does not fully overlap with the range of color temperatures provided by the second light. Therefore, especially during use, the first light and the second light differ in one or more of color, color temperature and intensity. Further, at a distance of the system (such as at a (predetermined) distance selected from the range of 0.2-5 m; see also below), where both first light and second light may be received, the system provides a light distribution or light pattern with variations ("distribution") of one or more of color, color temperature and intensity, especially in at least the intensity and one or more of color and color temperature.

Hence, the invention provides a lighting system ("system") comprising: (i) one or more first light sources configured to provide one or more first light beams, and (ii) one or more second light sources configured to provide one or more second light beams; wherein the lighting system is configured to provide one or more of (a) first light comprising one or more of said (one or more) first light beams, wherein one or more of the color and correlated color temperature of the first light is variable, and wherein especially also the intensity of the first light is variable, and (b) second light comprising one or more of said (one or more) second light beams wherein one or more of the color and correlated color temperature of the second light is variable, wherein the intensity of the second light is variable; and wherein especially also one or more of said first light and said second light have a variable directionality. Especially, the first light, which may primarily be used to mimic solar light, may have a v' value of at least 0.47 (according to CIE 1976 uniform chromaticity scale diagram (see also FIG. 5)), such as at least 0.475, and the second light, which may primarily be used to mimic a sky (without the sun) may have a lower v' value, such as below 0.47. The first light may have a u' value selected from the range of 0.15-0.5, especially 0.2-0.4 (according to CIE 1976 uniform chromaticity scale diagram). The u' value of the second light may substantially be any possible u' value.

With the present lighting system, light may for instance be projected on a ceiling, with (lighting system being) a kind of low resolution projector or display, whereby in an easy way the move of the sun may be mimicked, including color (temperature) changes of the solar light, and whereby in an easy way the sky may be mimicked, optionally with color and/or intensity changes. In this way, a sky can be mimicked, including its variation over the day. This may add to wellbeing of humans in a space where the lighting system is applied. Hence, the lighting system as described herein may amongst others be used for mimicking a sky (including the sun) by providing one or more of (a) first light and (b) second light to a ceiling (or other surface). Hence, the lighting system is especially configured for indoor applications. Further, the lighting system is especially configured for pendant applications. With the first light and the second light patterns may be created on the ceiling, or another surface, and new colors may be generated, as the first light and the second light can be mixed on the ceiling or another surface. In specific embodiments, the difference in v' value between the first light and the second light may be in the range of 0.05, such as 0.1, like in the range of 0.05-0.4. Note that different (first) subsets may provide light beams with different v' chromaticity coordinate of the CIE 1976 uniform chromaticity scale diagram. Likewise, different (second) subsets may provide light beams with different v' coordinates.

The (indoor) artificial daylighting system as described herein may in embodiments essentially consist of a pendant luminaire that illuminates a (large) area on the ceiling. The full area is illuminated by e.g. bluish white light that may contain static or dynamic patterns of white and blue to create the illusion of a sky. Next to that, part of the area may be illuminated with a much higher intensity and at a lower color temperature to mimic the light from the sun. Based on geographical location, season and time of day, the position, size and color temperature of the artificial sun can vary. Although the light (after reflection off the ceiling) is not parallel like direct sunlight, the position on the ceiling does create a sense of direction. Furthermore, by having areas with different CCT (the bluish "sky" vs. the warm white "sun"), a subtle color effect may be created in shadows on 3D objects. Hence, with a single system, a kind of McCandless effect is created. This effect may be used to create a naturalistic feel, enhance facial features of people, and, by tuning the relative strength of two lights with a different CCT, suggest a time of day in a room. The dynamic behavior may amongst others be triggered by one or more of direct daylight sensor input, a clock, GPS, information from smartphone apps, from the internet, etc. Data from the internet may e.g. include solar light data at a specific latitude, geographical place on earth, etc. etc.

In yet a further aspect, the invention provides a system, such as especially also described above, comprising: (a) at least two first subsets of first light sources configured to provide two or more first light beams in at least two or more different first directions, wherein the two or more first light beams have a color, especially selected from the group consisting of yellow, orange, red, and white light having a first correlated color temperature, of for instance of less than 6000 K, such as equal to or less than 5500 K; (b) one or more second subsets of one or more second light sources configured to provide one or more second light beams in one or more second directions, wherein the one or more second light beams have a color, especially selected from the group consisting of purple, violet, blue and white light having a second correlated color temperature (CCT), of for instance of more than 5500 K, such as more than 6000 K; and (c) optionally a control system configured to control (i) one or more of (a) intensities of the two or more first light beams and (b) one or more of colors and (first) correlated color temperatures of the two or more first light beams, and (ii) one or more of (c) one or more intensities of the one or more second light beams and (d) one or more of colors and (second) correlated color temperatures of the one or more second light beams. Especially, the lighting system is configured to provide one or more of (a) first light comprising one or more of said (one or more) first light beams, with the first light, having a variable angular distribution of one or more of intensity, color, and (first light) correlated color temperature, and (b) second light comprising one or more of said one or more second light beams, with the second light having one or more of a variable intensity, a variable color, and a variable (second light) correlated color temperature, especially at least having a variable intensity and optionally a variable color. Further, especially the at least two different directions and the one or more second directions are configured within a virtual cone having an apex angle of at maximum 180° and a virtual cone axis.

In yet a further aspect, the invention provides a lighting system ("system") comprising: (i) one or more first light sources configured to provide one or more first light beams, and (ii) one or more second light sources configured to provide one or more second light beams; wherein the lighting system is configured to provide one or more of (a) first light comprising one or more of said (one or more) first light beams, wherein one or more of the color and correlated color temperature of the first light is variable, wherein especially also the intensity of the first light is variable, and (b) second light comprising one or more of said (one or more) second light beams wherein one or more of the color and correlated color temperature of the second light is variable, wherein the intensity of the second light is variable; and wherein especially also one or more of said first light and said second light have a variable directionality, with the first light having a v' value of at least 0.47, such as at least 0.475, and an u' value selected from the range of 0.15-0.5, especially 0.2-0.4 (according to CIE 1976 uniform chromaticity scale diagram), and the second light, which may primarily be used to mimic a sky (without the sun) may have a color different from the first light. The v' and u' values of the second light may substantially be any possible v' and u' values outside the CIE 1976 diagram part defined by u'=0.2-0.4 and v'=0.475, or defined by u'=0.15-0.5 and v'=0.47 (or defined by intermediate parts).

The lighting system comprises a plurality of light sources. One or more of the light sources, may include optics to direct the light source light generated by the light source. The light sources especially comprise solid state light sources (see also below). Each light source may include a solid state light source. Optionally, one or more light sources may include a plurality of solid state light sources. The plurality of light sources can be subdivided in a plurality of subsets. The subsets may individually be addressed by the control system. Hence, for instance the intensity of all light sources in a subset may be decreased simultaneously. Especially, the characteristics such as maximum intensity, color (temperature) for the light sources within a subset are substantially identical. Especially, the light sources within a subset are within the same bin(s). However, a subset may also include a combination of light sources of different bins (for providing e.g. color control of the subset). Hence, the (control) system is especially configured to independently address the subsets. In embodiments, the lighting system includes at least three subsets. The minimum of two first subsets may be used to mimic the sun movement, such as during the day. The minimum of the second subset may be used to mimic the sky or azure. With three subsets a kind of resolution of three pixels may be obtained, which may have some similarity with the daylight changes during the day. Hence, with a relatively simple system, daylight can be mimicked much better. By adding subsets, the resolution can be increased and transitions may be smoother and/or more realistic.

The first light having a v' value of at least 0.47 may thus especially imply that each first light source may (be configured to) provide light source light with a v' value of at least 0.47. Likewise, the second light having a v' value smaller than 0.47 may thus especially imply that each second light source may (be configured to) provide light source light with a v' value lower than 0.47. However, the first light having a v' value of at least 0.47 may thus especially also imply that each first subset may (be configured to) provide light source light with a v' value of at least 0.47. Likewise, the second light having a v' value smaller than 0.47 may thus especially also imply that each second subset may (be configured to) provide light source light with a v' value lower than 0.47. A light source may include several solid state light sources. A subset may include a plurality of light sources.

Hence, in embodiments the system comprises at least two first subsets of first light sources. Even more especially, the system comprises at least three first subsets, such as 3-20 first subsets, like at least six first subsets. Note that the characteristics such as maximum intensity, color (temperature) for the light sources of the at least two first subsets may be the same or may be different. Better results may be obtained when there are a plurality of first subsets amongst which two or more at least also differ in color temperature. Note that when there are a plurality of first subsets best results may be obtained when each first subset differs in direction and/or color from another first subset.

The first light beam, especially the two or more first light beams have a color selected from the group consisting of yellow, orange, red, and white light having a correlated color temperature of for instance less than 6000 K, such as equal to or less than 5500 K.

Hence, the color of the first light (see also below), will especially be selected from light having a dominant wavelength in the range of about 565-630 nm, especially white light having a correlated color temperature of less than 6000 K, such as equal to or lower than 5500 K. In specific embodiments, the first light has a variable a correlated color temperature variable in at least a range of 3500-5000 K. A larger variable range may thus also be possible. Here, the term "correlated color temperature" refers to the CCT of the first light. The correlated color temperature may vary over a beam of said first light, as the first light may be composed of more than one beams of more than one (subsets of) first light sources.

The at least two first subsets are configured to provide two or more first light beams in at least two or more different first directions. The virtual sun movement in the sky may be mimicked by increasing the intensity of one of the subsets relative to the other, and vice versa. Especially when more than two first subsets are applied, one may also be able not to only move the first light (solar movement) but also adapt color point/correlated color temperature.

When two or more first subsets are applied, directionality of the first light may purely be achieved by selected different subsets; hence no movable, such as rotatable light source are (then) necessary.

Herein, instead of the term "configured to" also the term "adapted to" may be applied.

The lighting system may especially (be configured to) provide light in a halve sphere or hemisphere, or part thereof. Hence, the at least two different directions are configured within a virtual cone having an apex angle (a) of at maximum 180° (hemisphere), especially less than 180°, such as about at maximum 135°. During use of the system, the apex of the virtual cone may point downwards, and the base of the virtual cone may be directed to the ceiling. The term "virtual cone" refers to a cone that is virtually present. The lighting system may have any geometry.

The lighting system thus further comprises one or more second subsets of one or more second light sources, especially at least two second subsets of second light sources, even more especially at least three second subsets, such as at least four second subsets. Hence, in embodiments the lighting system may comprise 2-10 second subsets, such as 4-10 second subsets. With at least two second subsets, the sky may be mimicked in a better way and/or resolution can be higher. Note that the characteristics such as maximum intensity, color (temperature) for the light sources of the second subsets (assuming at least two second subsets) may be the same or may be different. Better results may be obtained when there are a plurality of second subsets amongst which two or more at least also differ in color temperature. Note that when there are a plurality of second subsets best results may be obtained when each second subset differs in direction and/or color from another second subset.

The one or more second light beams have a color selected from the group consisting of purple, violet, blue and white light having a correlated color temperature (CCT) of more than 5500 k, especially more than 6000 K, such as more than 6500 K.

Hence, the color of the second light (see also below), will especially be selected from light having a v' of less than about 0.47 (CIE 1976 uniform chromaticity scale diagram), such as especially white light having a correlated color temperature of more than 6000 K. In specific embodiments, the second light has a variable a correlated color temperature variable in at least a range of 6500-8000 K. A larger variable range may thus also be possible. The control system may be configured to gradually change the correlated color temperature of the second light by controlling the correlated color temperature of the one or more second light beams. Here, the term "correlated color temperature" refers to the CCT of the second light. The correlated color temperature may vary over a beam of said second light, as the second light may be composed of more than one beams of more than one (subsets of) second light sources.

Optionally, the ranges wherein the correlated color temperatures of the first light and of the second light may be variable may partially overlap. In yet other embodiments, the ranges do not overlap.

The system is especially configured to provide one or more second light beams in one or more second directions. With the second subset(s) the sky (without the sun), herein also indicated as "azure" may be mimicked. The virtual sun movement in the sky may be mimicked by increasing the intensity of one of the subsets relative to the other, and vice versa. Especially when two ore more, especially more than two second subsets are applied, one may also be able to change the color of the sky as it may also change during the day.

The one or more second light sources are configured to provide one or more second light beams in one or more second directions. Whereas within the plurality of first subsets there may be first beams that do not substantially overlap (at a predetermined distance selected from the range of 0.2-5 m, especially 0.2-1 m, from the lighting system), as especially the movement of the sun is to be mimicked, when there are two or more second subsets the second light beams may overlap (at a predetermined distance selected from the range of 0.2-5 m, especially 0.2-1 m, from the lighting system), as especially the sky is to be mimicked. The one or more second directions is (are) thus especially also configured within the same virtual cone having the apex angle (a) of at maximum 180° (hemisphere), especially less than 180°, such as at maximum about 135°.

Especially, the area defined by the beam width (full width half maximum, FWHM) of the second light beam (at a predetermined distance selected from the range of 0.2-5 m, especially 0.2-1 m, from the lighting system), or the area defined by the overlapping areas defined by the beam widths of the second light beams (at a predetermined distance selected from the range of 0.2-5 m, especially 0.2-1 m, from the lighting system) may define the area in which the first light may move, as the former may define the sky and the latter may define the sun movement. In general, the resolution, defined by the number of subsets, of the first subsets is higher than the resolution of the second subsets.

In yet other embodiments, the lighting system may (additionally) include one or more moveable parts, such as one or more of movable light sources and movable optics. Also in this way, directionality may be introduced.

The system further comprises a control system. The control system is especially configured to control (i) intensity and/or color of the first light beams and/or (ii) intensity (and/or color) of the second light beam(s). Hence, the control system is especially configured to control (i) one or more of (a) intensities of the (two or more) first light beam(s) and (b) one or more of color(s) and (first) correlated color temperature(s) of the (two or more first) light beam(s), and (ii) one or more of (c) one or more intensities of the one or more second light beams and (d) one or more of colors and (second) correlated color temperatures of the one or more second light beams. Note that by controlling the color and/or intensity of the first subsets a solar movement may be mimicked, for instance in an embodiment by having low or no intensity of one of the first light beams and increasing intensity of another one of the first light beams, and gradually changing this to substantially only intensity in the former light beam by gradually increasing its intensity and gradually decreasing the intensity of the latter.

Hence, in this way light may be provided by the first subset(s) that may gradually move over a ceiling, and optionally also gradually changes in color or correlated color temperature, mimicking a sun movement and behavior over a sky, with the latter being provided by the light from the one or more second subsets. Hence, especially, the lighting system is configured to provide first light comprising one or more of said (one or more) first light beams, with the first light, having a variable angular distribution of one or more of intensity, color, and correlated color temperature. Alternatively, and especially additionally, the lighting system is also configured to provide second light comprising one or more of said one or more second light beams, with the second light having one or more of a variable intensity, a variable color, and a variable correlated color temperature, especially at least having a variable intensity and optionally a variable color. When there is only a single second subset, only intensity of the second light beam may be controllable. Hence, in specific embodiments the lighting system comprises at least two second subsets of second light sources, thereby providing second light having a variable angular distribution of one or more of intensity, color, and correlated color temperature.

As indicated above, the distribution of the light, the color of the light, etc. is variable. By varying in time such parameters, a sky, including a sun, may be mimicked. Therefore, in embodiments the control system is especially configured to vary one or more of (a) the angular distribution of the intensity of the first light, (b) the angular distribution of one or more of the color and the correlated color temperature of the first light, (c) the intensity of the second light, and (d) the color of the second light as function of time (such as a clock). As indicated above, in specific embodiments the lighting system comprises at least two second subsets of second light sources. Therefore, in such embodiments the control system may especially be configured to vary one or more of (a) the angular distribution of the intensity of the first light, (b) the angular distribution of one or more of the color and the correlated color temperature of the first light, (c) the angular distribution of the intensity of the second light, (b) the angular distribution of one or more of the color and the correlated color temperature of the second light, as function of time (such as a clock). Alternatively, the control system may especially be configured to vary one or more of these as function of one or more of time, a GPS signal, and daylight sensor input.

Alternatively or additionally, one or more of these parameters may be controlled in dependence of one or more of geographical location, season, and time of day, etc. Alternatively or additionally, one or more of these parameters may be controlled in dependence of one or more of a direct daylight sensor input, GPS, information from smartphone apps, information from the internet, etc. For instance, a sunny day may be translated to the lighting characteristics of the lighting system, whereas the lighting system may also change the lighting characteristics when it is cloudy outside. Further, in embodiments a user may control one or more of these parameters via a user interface. This user interface may be integrated in the lighting system, but may also be remote from the lighting system (remote control). Hence, the user interface may in embodiments be integrated in lighting system but may in other embodiments be separate from the lighting system. The user interface may e.g. be a graphical user interface. Further, the user interface may be provided by an App for a Smartphone or other type of android device, an iPhone, etc.

The control system may be used to provide one or more lighting programs, wherein during at least one or more of such programs one or more, especially both the first light and the second light are provided. However, the lighting system may also be configured to allow a user deviate from such program, and to choose (with a user interface) (i) one or more of the color, correlated color temperature, and the intensity of the first light, and/or (ii) one or more of the color, correlated color temperature, and the intensity of the second light. Alternatively or additionally, the lighting system may also be configured to allow a user deviate from such program, and to choose (with a user interface) a directionality of one or more of said first light and said second light. In this way, a user may create its own pattern on a ceiling or surface including e.g. color, color temperature, and intensity gradients.

In yet a further aspect, the invention also provide a method of providing light, especially a method of illuminating an object, such as of illuminating a ceiling, wherein the lighting system as described herein is applied, and wherein one or more of the first light and the second light are provided, especially wherein both are provided, and wherein especially during a period one or more of intensity, color and color temperature of one or more of the first light and the second light are varied in time.

Therefore, the invention also provides (in a further aspect) a computer program product, optionally implemented on a record carrier (storage medium), which when run on a computer executes the method as described herein (see below) and/or can control the system as described herein. For instance, the (control) system may be configured to run (on demand by a user) one or more of the herein (below) defined programs.

Especially, the lighting system is configured to gradually change one or more of color, angle, and intensity of the first light and/or of the second light, especially at least of the first light. In addition thereto, the lighting system may (thus) also allow a user select one or more of color, angle, and intensity of the first light and/or of the second light.

Hence, assuming a maximum intensity of 100% (wherein I reflects a measure for the intensity) for a beam of light, in embodiments a program may be applied (by the control system) wherein a change in intensity of the beam is especially equal to or smaller than 1*00%/h, especially equal to or smaller than ½*100%/h, such as $\frac{1}{16}$*100/h-½*100%/h, especially at least $\frac{1}{24}$*100%/h. Hence, a change in intensity from 0 to 100% intensity or vice verse would last at least an hour (or may e.g. even take 16 hours). Intensity can e.g. be defined in lumen or candelas.

Likewise, in embodiments a program may be applied (by the control system) wherein a change in angle of a direction of the first light is especially equal to or smaller than 180°/h, especially equal to or smaller than (180°/2)/h, such as (180°/16)/h-(180°/2)/h. Likewise, in embodiments a program may be applied (by the control system) wherein a change in angle of the first light is especially equal to or smaller than 10°/h, especially equal to or smaller than (180°/2)/h, such as (180°/16)/h-(180°/2)/h, especially at least (180°/24)/h. The same may apply to a direction of the second light, though here the change may even be more gradual or there may even be substantially no angular change of the direction of the second light. For instance, the change in angle may be in the range of 5-30° per hour, like 10-20° per hour.

Likewise, in embodiments a program may be applied (by the control system) wherein a change in color point of a beam of light is especially equal to or smaller than 0.25/h, especially equal to or smaller than (0.25/2)/h, such as (0.25/16)/h-(0.25/2)/h, especially at least (0.25/24)/h. Here, the value of 0.25 may refer to a (change in) x-coordinate and/or y-coordinate of the color coordinate diagram (CIE 1931).

Hence, in embodiments the (control) system is especially configured to gradually shift the intensity of the first light from one side of the virtual cone axis to another side of the virtual cone axis by controlling the intensities and of the two or more first light beams. This may mimic the path of the sun over the sky. Hence, in specific embodiments the (control) system is configured to execute a maximum (angular) shift in at minimum 1 hours, such as at minimum 2 hours, such as at least 4 hours, such as at least 8 hours (about a working day), like at least 10 hours (office opening hours), or even up to 16 hours or more, like at maximum 24 hours. For instance, the maximum angular shift may be at least 10°, such as at least 20°, such as at least 30°, like in the range of at least 10° to less than 180°. Likewise, this might apply to an optional angular shift of the second light. The term angular shift may especially refer to a shift of an optical axis and or a shift of a maximum intensity (of the first or second light).

As indicated above, the system may be configured to gradually change the color. Alternatively or additionally, in embodiments the control system is configured to gradually vary the correlated color temperature of the first light from a first minimum via a first maximum to a second minimum, with a minimum change of at least 500 K up and a minimum change of at least 500 K down. In yet further embodiment, a program may be applied (by the control system) wherein a change in correlated color temperature of the first light is especially equal to or smaller than 4000K/h, especially equal to or smaller than (4000K/2)/h, such as (4000K/16)/h-(4000K/2)/h, such as at least (4000K/24)/h. In further embodiments, the control system may (also) be configured to gradually change the correlated color temperature of the second light by controlling the correlated color temperature of the one or more second light beams. Especially, in such embodiments a program may be applied wherein a change in correlated color temperature of the second light is especially equal to or smaller than 8000K/h, especially equal to or smaller than (8000K/2)/h, like equal to or smaller than (8000K/4)/h such as (8000K/16)/h-(4000K/2)/h, like at least (8000K/24)/h.

In specific embodiments, the (one or more) first light sources(s) and the (one or more) second light source(s) comprise solid state light source(s). Further, in specific embodiments the total number of solid state light sources is at maximum 5000. For instance, a 50*50 array of solid state light sources, such as LEDs, may be applied. Hence, with a relative low resolution (max. 50*50 when a 50*50 array is provided; however, optionally resolution can be lower when more than one solid state light sources are within the same subset), lighting quality may be improved with the present lighting system.

In yet further, embodiments the system may comprise in total at maximum 50*50 subsets (first and second subsets), and especially at least 3 subsets (first and second subsets), such as at least 5 subsets (first and second subsets).

As indicated above, the first light beams may provide colored light or white light. Further, one or more first light beams may provide white light and one or more other light beams may provide colored light. Likewise, the second light beam(s) may provide colored light or white light. Further one or more first light beams may provide white light and one or more other light beams may provide colored light.

Therefore, in embodiments the two or more first light beams have a white color light having (first) correlated color temperatures of equal to or less than 5500 K, wherein the correlated color temperatures of at least two of the two or more first light beams differ by at least 500 K, such as at least 1000 K. In further embodiments, two or more of the two or first light beams have a white color light having (first) correlated color temperatures of equal to or less than 5500 K. The (first) correlated color temperatures of at least two of the two or more first light beams may differ, especially by at least 500 K, such as at least 1000 K. Additionally or alternatively, one or more (other) first light beams have a color (i.e. non-white). Further, the color temperature distribution may vary over the first light.

In yet further embodiments, the one or more second light beam(s) have a white light color having a (second) correlated color temperature of equal to or more than 6500 K. In further embodiments, two or more second light beam(s) have a white light color having a correlated color temperature of equal to or more than 6500 K, wherein the (second) correlated color temperatures of the two or more second light beams differ, especially by at least 500 K, such as at least 1000 K. In yet further embodiments, the lighting system is configured to provide a plurality of second light beams, wherein two or more of the two or second light beams have a white color light having (second) correlated color temperatures of equal to or more than 6500 K. The (second) correlated color temperatures of at least two of the two or more second light beams may differ, especially by at least 500 K, such as at least 1000 K. Additionally or alternatively, and one or more (other) second light beams have a color (i.e. non-white). Further, the color temperature distribution may vary over the second light.

It appears to be beneficial to arrange a lens, such as a Fresnel lens, in front of a plurality of light sources. Hence, in embodiments the lighting system further comprises a lens, configured downstream of one or more first light sources, configured downstream of one or more of the one or more second light source(s), or configured downstream of one or more first light sources and one or more of second light sources. Especially, a lens may be configured downstream of at least the first light sources. Further, for instance to avoid sharp boundaries a diffuser may be applied downstream of one or more of the light sources. Therefore, in embodiments the lighting system further comprises a diffuser, configured downstream of one or more first light sources, configured downstream of one or more of the one or more second light source(s), or configured downstream of one or more first light sources and one or more of second light sources.

The terms "upstream" and "downstream" relate to an arrangement of items or features relative to the propagation of the light from a light generating means (here the especially the light source), wherein relative to a first position within a beam of light from the light generating means, a second position in the beam of light closer to the light generating means is "upstream", and a third position within the beam of light further away from the light generating means is "downstream".

In a further aspect, the invention provides a lighting system comprising: (a) one or more first subsets of first light sources configured to provide one or more first light beams, wherein one or more first light sources are movable, such as rotatable, associated with the lighting system, such that one or more first light beams may be provided in two or more different first directions, wherein the one or more first light beams have a color selected from the group consisting of yellow, orange, red, and white light, for instance having a (first) correlated color temperature of less than 6000 K; (b) one or more second subsets of one or more second light sources configured to provide one or more second light beams, wherein one or more second light sources may optionally be movable, such as rotatable, associated with the lighting system, such that one or more second light beams may be provided in one or more second directions, wherein the one or more second light beams have a (second) color selected from the group consisting of purple, violet, blue and white light, for instance having a correlated color temperature of more than 6000 K; (c) optionally a control system configured to control (i) one or more of (a) intensities of the two or more first light beams and (b) one or more of colors and (first) correlated color temperatures of the two or more first light beams, and (ii) one or more of (c) one or more intensities of the one or more second light beams and (d) one or more of colors and (second) correlated color temperatures of the one or more second light beams. The lighting system is especially configured to provide one or more of (a) first light comprising one or more of said (one or more) first light beams, with the first light, having a variable angular distribution of one or more of intensity, color, and correlated color temperature, and (b) second light comprising one or more of said one or more second light beams, with the second light having one or more of a variable intensity, a variable color, and a variable correlated color temperature; wherein the at least two different directions, and wherein the one or more second directions are especially configured within a virtual cone having an apex angle of at maximum 180° and a virtual cone axis. Especially, the control system may be configured to (also) control the direction(s) of one or more first light sources and optionally also the direction(s) of one or more second light sources. Alternatively or additionally, optics may be movable, such as rotatable. Also in this way the direction of one or more (first and/or second) light beams may be controlled. The control system may control also (such) movable elements, like movable optics.

The lighting system may especially be configured as pendant lighting device. Further, the lighting device may especially be configured to illuminate an area, such as part of a ceiling, either directly, or via a mirror. Yet further, the lighting system may also provide light in another direction that those of the first light beams and second light beams. The first and second light beams may be used for creating a sky (with sun) impression. Hence, these beams may not directly be used for illuminating a room. Hence, in embodiments the lighting system further comprises a third light source configured to provide a third light beam (IL) in a third direction, configured outside the virtual cone. Especially, such third light may be white light. Hence, the invention also provides embodiments of the lighting system further comprising a third light source configured to provide a third light beam in a third direction different from the at least two or more different first directions and the one or more second directions.

The present invention thus provides in embodiments an artificial sunlight centerpiece luminaire, such as a luminaire above a dinner table.

In yet a further aspect, the invention provides a lighting system comprising a plurality of first light sources and a plurality of second light sources, configured in a (regular) array, the lighting system further comprising a control system, configured to control the plurality of first light sources and a plurality of second light sources, wherein the first light sources are (independently) controllable, and wherein the second light sources are (independently) controllable, wherein (in a program) during use the control system is configured to vary with time the intensity of the first light sources (wherein especially two or more first light sources mutually differ in intensity), and wherein especially a variation in time of the intensity of first light sources differs from a variation in time of the intensity of the second light sources (if any). Additionally or alternatively, the variation may in time may also be in color and/or color temperature of the first light sources (wherein especially two or more first light sources mutually differ in color and/or color temperature), and optionally of the second light sources, wherein especially a variation in time of the color and/or color temperature of first light sources differs from a variation in time of the color and/or color temperature of the second light sources (if any). In this way, there may be a variable spatial distribution (in time) of the light of the first light sources over the lighting system and optionally also a variable spatial distribution (in time) of the light of the second light sources over the lighting system. The resolution of the array may be as defined above. Such system may e.g. comprise a plurality of luminaires.

The lighting system may be configured to control an angular distribution of color, color temperature and intensity of the first light and/or second light. The lighting system may be configured to control a spatial distribution of color, color temperature and intensity of the first light and/or second light. The term distribution may especially refer to a non-homogeneous distribution. Hence, when the control system executes a program, there may be periods wherein one or more of the first light and second light are inhomogeneously distribution at a surface at a predetermined distance selected from the range of 0.2-5 m, especially 0.2-1 m, from the lighting system.

The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL.

The terms "violet light" or "violet emission" especially relates to light having a wavelength in the range of about 380-440 nm. The terms "blue light" or "blue emission" especially relates to light having a wavelength in the range of about 440-495 nm (including some violet and cyan hues). The terms "green light" or "green emission" especially relate to light having a wavelength in the range of about 495-570 nm. The terms "yellow light" or "yellow emission" especially relate to light having a wavelength in the range of about 570-590 nm. The terms "orange light" or "orange emission" especially relate to light having a wavelength in the range of about 590-620 nm. The terms "red light" or "red emission" especially relate to light having a wavelength in the range of about 620-780 nm. The term "pink light" or "pink emission" refers to light having a blue and a red component. Instead of the term "pink" also the term "purple" may be applied. Pink and purple refer to as a range of hues of color between blue and red. The terms "visible", "visible light" or "visible emission" refer to light having a wavelength in the range of about 380-780 nm.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

DETAILED DESCRIPTION OF THE EMBODIMENTS

Daylight through windows results in lighting that differs from indoor lighting with regard to flux, color temperature, directionality, information content about weather conditions and environment, and dynamics. Because of the positive associations and possible beneficial effects on health and well-being, there have been several attempts to mimic the effects of daylight with artificial indoor lighting systems. While the light effect gains in convincing power by adding more aspects of daylighting, this generally requires a large, complicated and expensive lighting installation. We propose a simple, low-cost suspended luminaire that recreates daylighting effects (high flux, variable CCT, gradients and slow dynamics) by projection of a low-resolution (few pixels) sky and sun on the ceiling. We note that the projection could also be performed by a beamer, but it would require a very high output beamer to mimic sunlight effects. A general purpose beamer also has a resolution and speed that are not needed to project slowly varying sky images with a low image content. Therefore the embodiments of our invention contain simple and low-cost means to project the sky images onto the ceiling. Instead of recreating exact and realistic sunlight and sky spectra (the average around 6000K is not always pleasant in an indoor environment), it is also an option to shift the average CCT value to e.g. 3000K-4000K, and use CCT shifts around this average value to create an artificial sky impression. Instead of providing a detailed—and costly—projection image of the sky, we propose to use a substantially low-resolution image based on substantially smooth gradients.

Figure 1A:
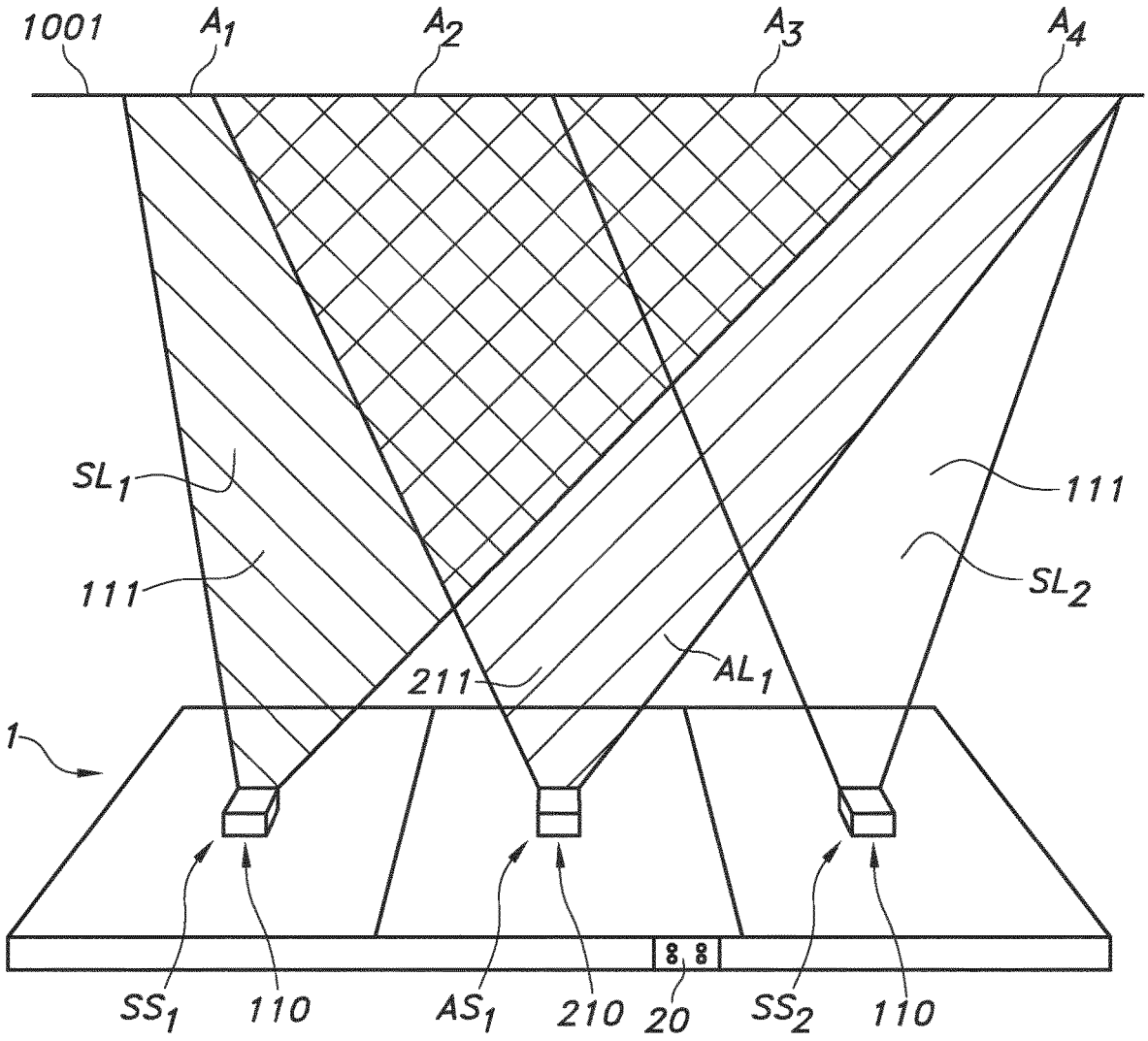
FIGS. 1*a*-1*d* schematically depict some aspects of the herein described lighting system.

FIG. 1*a* schematically depicts an embodiment of a lighting system 1 as described herein. The lighting system 1 comprises at least two first subsets SS1, SS2, . . . of first light sources 110 configured to provide two or more first light beams SL1, SL2, . . . in at least two or more different first directions. For instance, the two or more first light beams SL1, SL2, . . . have a color selected from the group consisting of yellow, orange, red, and white light having a correlated color temperature of less than 6000 K. As can be derived from FIG. 1*a*, the lighting system 1 may illuminate a hemisphere or part thereof. Here, the cone in which light is directed has an apex angle of about 45° (see also below) in more detail in FIG. 1*b*.

The lighting system 1 further comprises one or more second subsets AS1, . . . of one or more second light sources 210 configured to provide one or more second light beams AL1, . . . in one or more second directions. For instance, the one or more second light beams AL1, . . . have a color selected from the group consisting of purple, violet, blue and white light having a correlated color temperature of more than 6000 K. Here, a single second subset AS1 is depicted. The first subset(s) is (are) especially configured to imitate the sun (S), and the second subset(s) is (are) especially configured to imitate the sky (azure (A)).

The system 1 further comprises a control system 20 configured to control one or more of (a) intensities of the two or more first light beams SL1, SL2, . . . , respectively, (b) one or more of colors and correlated color temperatures of the two or more first light beams SL1, SL2, . . . , respectively, (c) one or more of (i) one or more intensities of the one or more second light beams AL1, . . . (, respectively), and (ii) one or more of colors and correlated color temperatures of the one or more second light beams AL1, . . . . (, respectively).

In embodiments, the control system 20 is configured to control the color and intensity of a first light 111 (composes of one or more first light beams) and/or a second light 211 (composed of one or more second light beams), and also directionality of the first light 111 (and optionally also the second light 211).

Reference 1001 indicates a ceiling, which is illuminated by the light of the lighting system 1.

Figure 5:
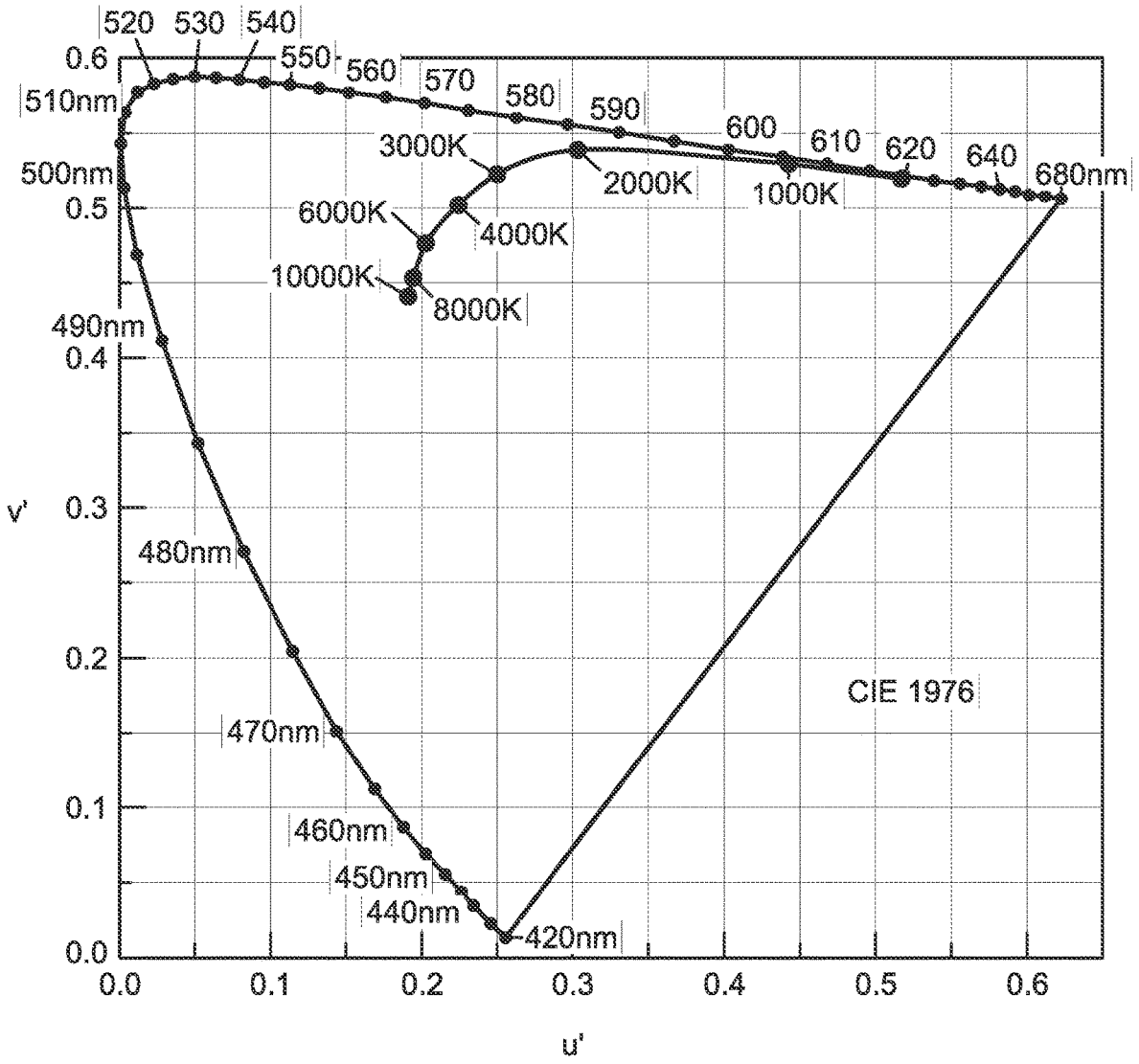
FIG. 5 depicts the CIE 1976 (u', v') uniform chromaticity diagram calculated using the CIE 1931 2° standard observer and Planckian locus (derived from https://www.ecse.rpi.edu/~schubert/Light-Emitting-Diodes-dot-org/chap18/F18-04%20u'v'%20Chromaticity%20diagram%20-%20planckian.jpg, which refers to E. F. Schubert, Light-Emitting Diodes, Cambridge University Press) as known in the art.

The system 1 provides in the schematically depicted embodiment light 111 and 211 on the ceiling 1001. Different regions A1-A4 can be distinguished. For instance, the light beam SL1 received at region A1 may have a v' value of at least 0.47 (see also FIG. 5) and the light beam SL2 received at region A4 may also have v' value of at least 0.47, though this value may optionally differ from the v' value of the light beam SL1. Would light beam AL1 not be provided, regions A2 and A3 will receive light having a v' ranging from the v' value of SL1 and the v' value of SL2. When light beam AL1 is also provided, region A4 will receive light having a v' value ranging from about the v' value of the light beam SL2 and the v' value of the light beam AL1. In regions A2 and A3 all three beams SL1, AL1 and SL2 are overlapping. In this way, a color gradient may be obtained. Of course, the colors of the regions may vary in time, as the intensities of the three beams SL1, AL1 and SL2 may vary in time. However, a user may in embodiments also choose a fixed setting of the first light source(s) 110 and the second light source(s) 210.

Figure 1B:
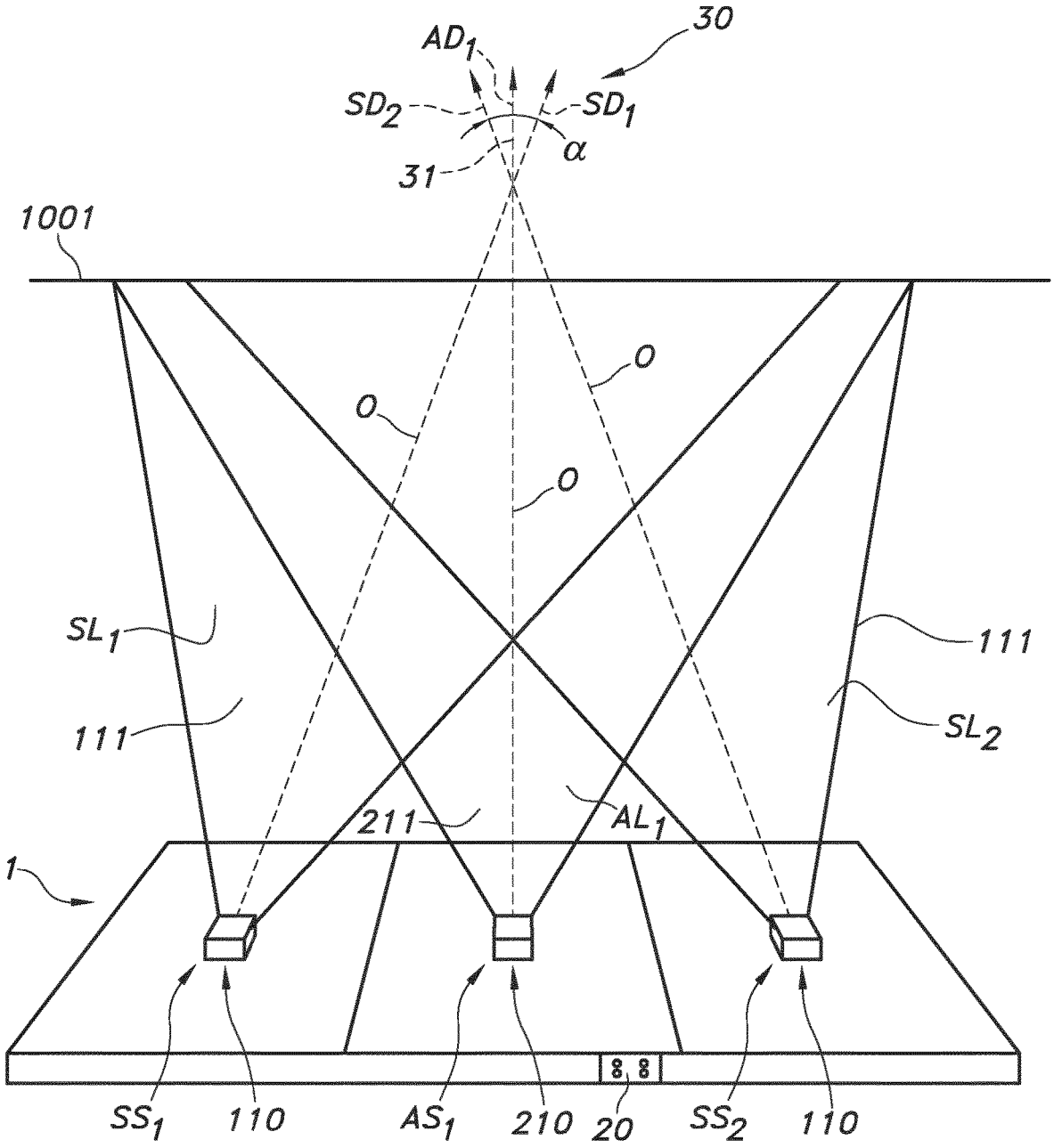

FIG. 1*b* schematically shows substantially the same drawing, but now including the directions of the light beams SL1, SL2, and AL1, which are indicated with the dashed lines SD1, SD2 and AD1, respectively. The at least two different directions SD1, SD2, . . . and the one or more second directions AD1, . . . are configured within a virtual cone 30 having an apex angle α of at maximum 180° and a virtual cone axis 31. Here, the apex angle α is about 45°.

A first light 111 is composed of the one or more first light beams SL1, SL2, . . . , which may not necessarily all be switched on at the same time during use. A second light 211 is composed of the one of more second light beams AL1, . . . . Hence, the lighting system 1 is configured to provide one or more of (a) first light 111 comprising one or more of said (one or more) first light beams SL1, SL2, . . . , with the first light 111, having a variable angular distribution of one or more of intensity, color, and correlated color temperature, and (b) second light 211 comprising one or more of said one or more second light beams AL1, . . . , with the second light 211 having one or more of a variable intensity, a variable color, and a variable correlated color temperature. Would the intensity of the second first light beam SL2 be zero and would the first light beam SL1 be completely reduced while increasing the intensity of the second first light beam SL2 there would be an angular shift of the light 111 of about 45° (apex angle α). References O indicate the respective optical axes of the light beams SL1, AL1, and SL2.

Figure 1C:
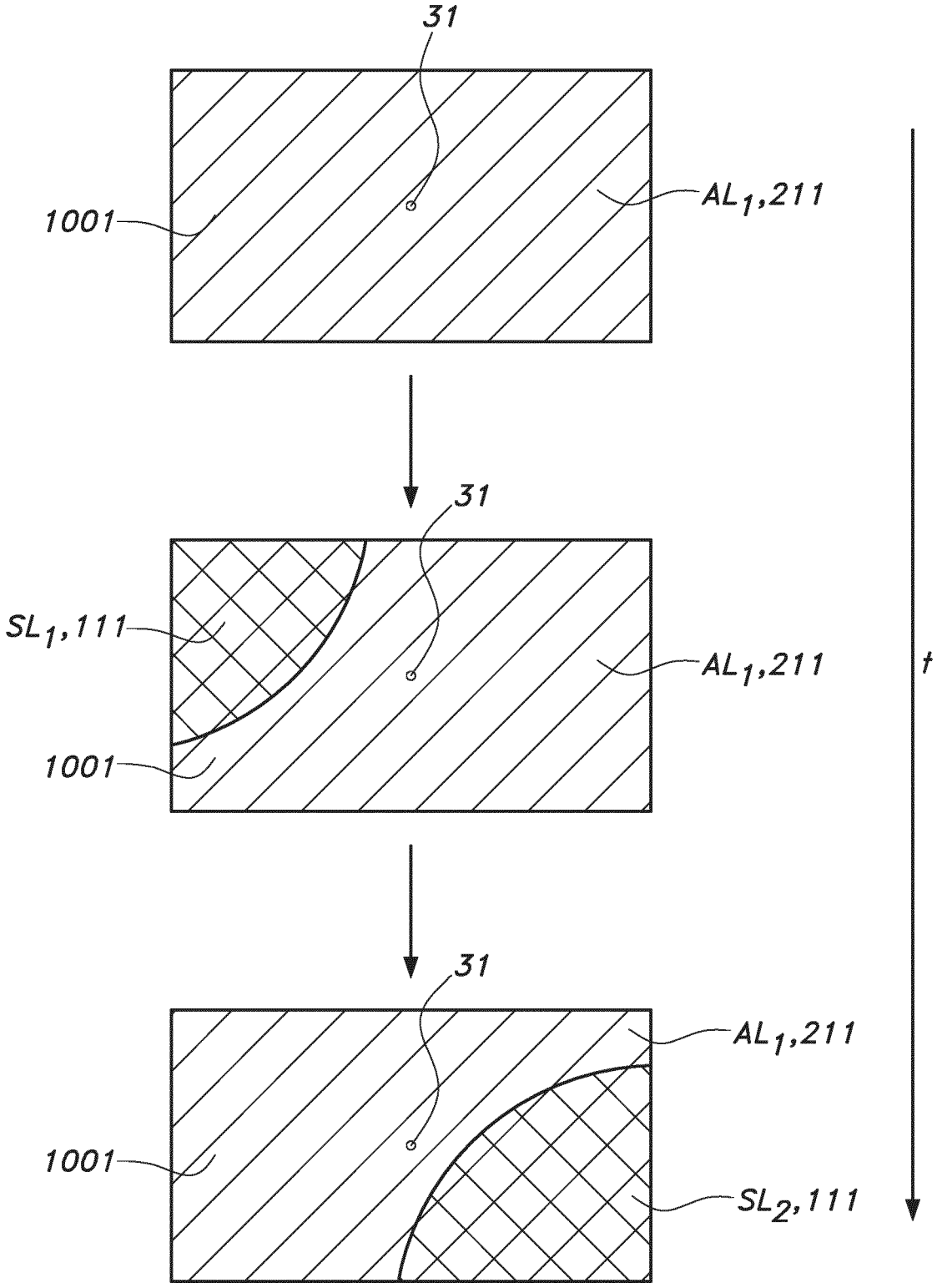

FIG. 1*c* schematically depicts a non-limiting example how the lighting system 1 may execute a program. First, the lighting system substantially provides only second light 211, provided by the one or more second light beams, here, in correspondence with FIGS. 1*a*-1*b*, only a single second light beam ALL Intensity may be low. This may e.g. refer to a situation shortly before sunrise. Then, in a next stage, the program, i.e. control system, maintains the second light 211, optionally with some more intensity, but now fades in the first light beam SL1. In this stage, the first light 111 thus essentially may consist of the first light beam SL1. Thereafter, gradually the second light beam SL2 may be introduced, and the first light beam SL1 may be faded out, leading to a stage as schematically depicted in the lower drawing, where only the second first light beam SL2 is available, and thus the first light 111 essentially may consist of this first light beam. Note that in an intermediated stage, not depicted, the first light 111 may have comprised both first beams SL1 and SL2. Also in the final stage depicted, still second light 211 may be available.

Figure 1D:
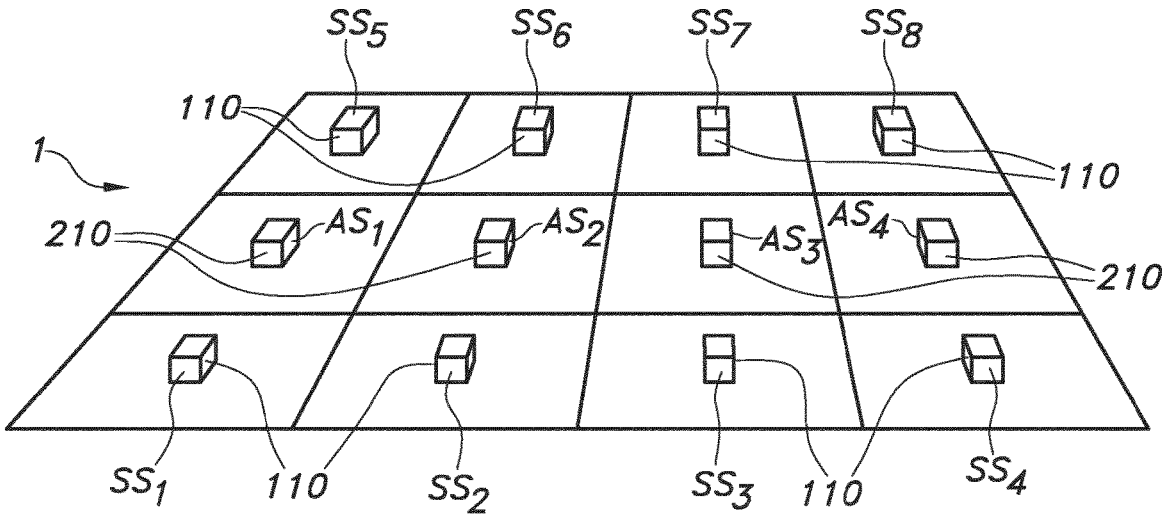

FIG. 1*d* schematically depicts an embodiment, wherein the lighting system 1 comprising 3-20 first subsets SS1, SS2, SS3, . . . and 2-10 second subsets AS1, AS2, . . . . Here, by way of example 8 first subsets SS (SS1-SS8) and 4 second subsets AS (AS1-A54) are schematically depicted.

Figure 2A:
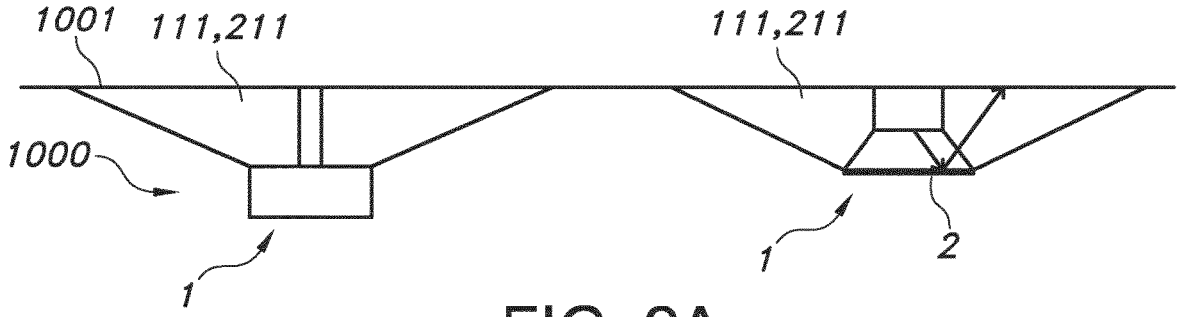
FIGS. 2*a*-2*b* schematically depict some variants.

FIG. 2*a* schematically depict two variants of the lighting system 1, with on the left positioned as suspended luminaire and on the right mounted on the ceiling and projecting via a suspended reflective surface 2 to the ceiling. The lighting systems 1 are configured in a space 1000, such as a room. The term space may for instance relate to a (part of) hospitality area, such as a restaurant, a hotel, a clinic, or a hospital, etc. The term "space" may also relate to (a part of) an office, a department store, a warehouse, a cinema, a church, a theatre, a library, etc. However, the term "space" also relate to (a part of) a working space in a vehicle, such as a cabin of a truck, a cabin of an air plane, a cabin of a vessel (ship), a cabin of a car, a cabin of a crane, a cabin of an engineering vehicle like a tractor, etc. The term "space" may also relate to (a part of) a working space, such as an office, a (production) plant, a power plant (like a nuclear power plant, a gas power plant, a coal power plant, etc.), etc. For instance, the term "space" may also relate to a control room, a security room, etc.

Figure 2B:
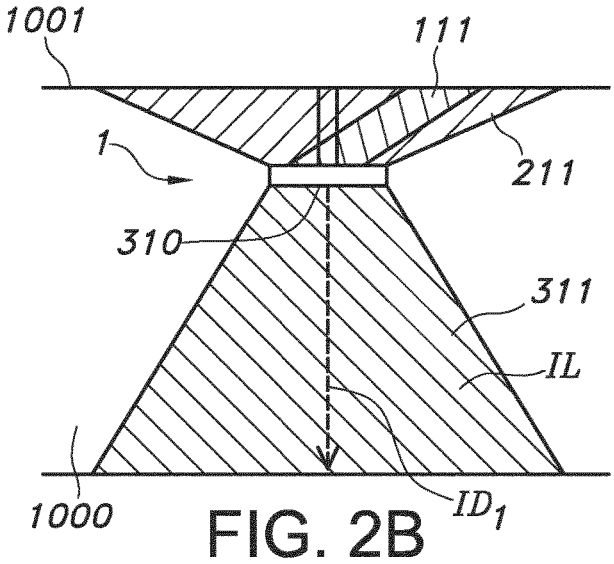

FIG. 2*b* schematically depicts an embodiment wherein the lighting system 1 further comprises a third light source 310 configured to provide a third light beam IL in a third direction ID1, configured outside the virtual cone 30 (see FIG. 1*b*). Reference 311 indicates second light, generated by one or more third light source(s) 310, which together provide third light beam IL.

Figure 3A:
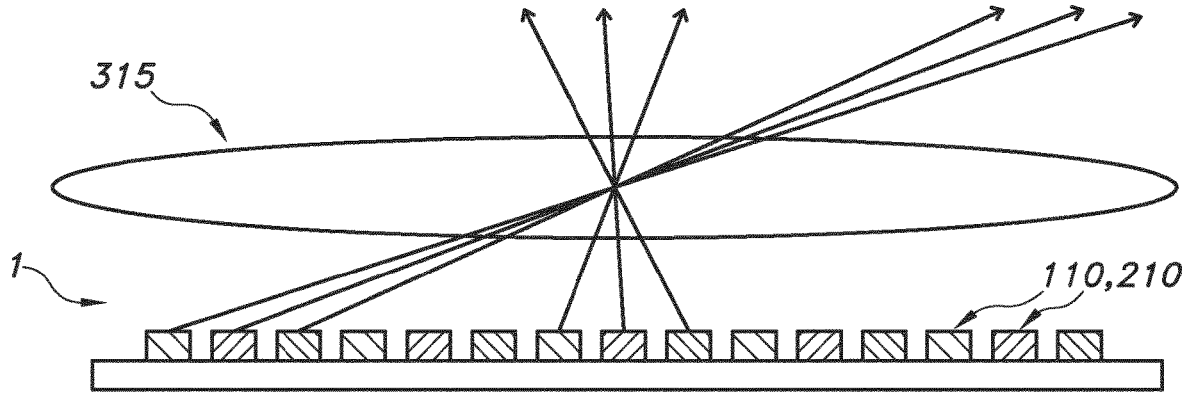
FIGS. 3*a*-3*e* schematically depict some further variants.
Figure 3B:
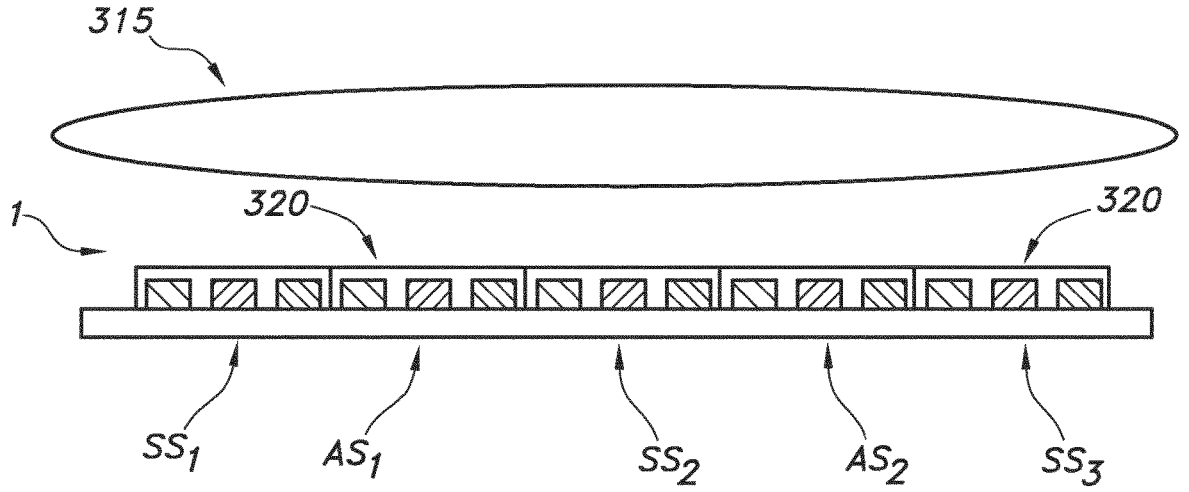
Figure 3C:
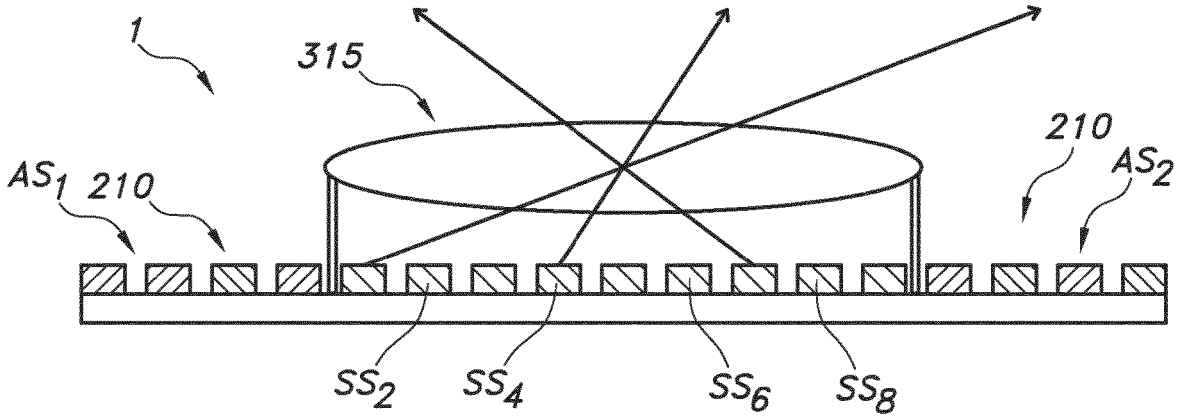
Figure 3D:
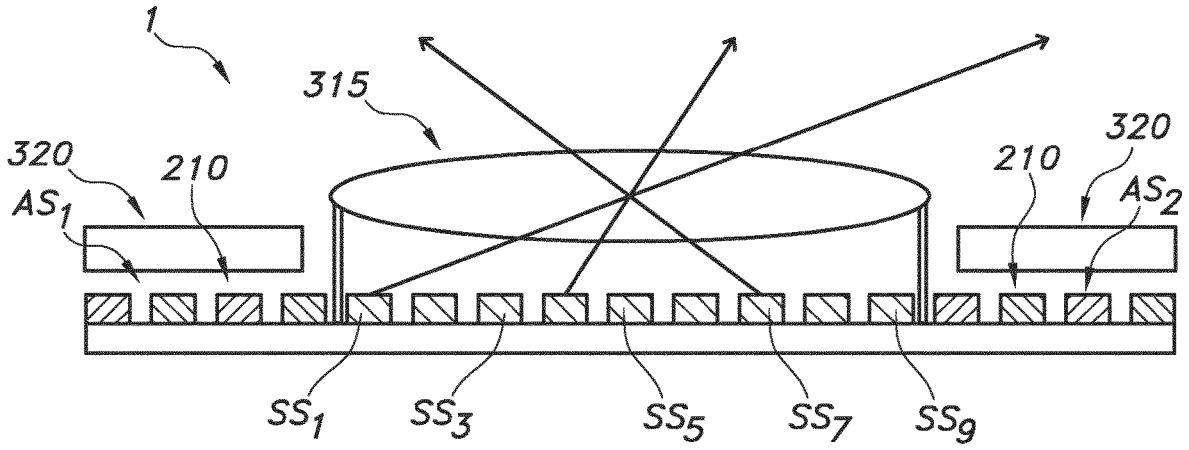
Figure 3E:
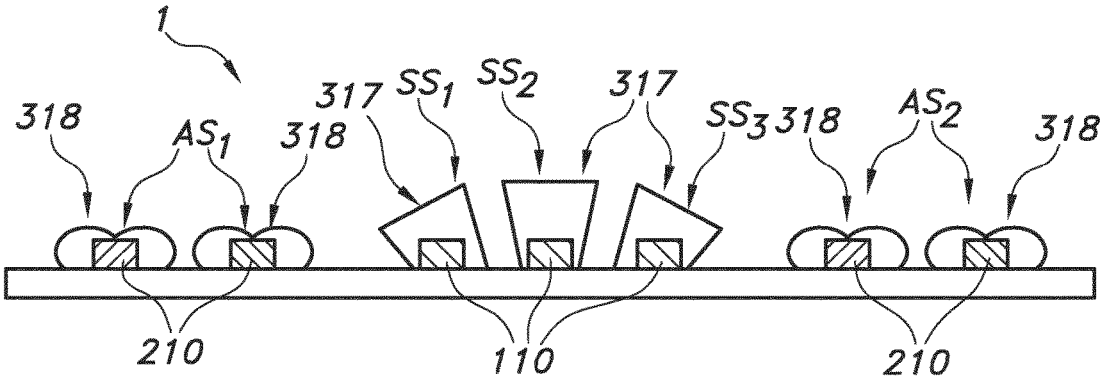

FIGS. 3*a*-3*e* schematically depict a number of variants. FIG. 3*a* schematically depict a LED matrix with warm white, neutral white and bluish white LEDs. A larger lens (or Fresnel) lens images the pattern, e.g. to a ceiling. The lens may be (slightly) out of focus, and/or may be combined with a (weak)diffuser to avoid visibility of the separate LEDs. The lens is indicated with reference 315, and is here configured downstream of all light sources 110,210. Note that different subsets may be created. FIG. 3*b* schematically depicts a LED matrix that is split up in small mixing cavities to allow for sharp images without colored edges. The cavities may include downstream of the light sources diffusers 320. Here, by way of example each cavity is a subset. However, also single light sources may form a subset and/or light sources in different cavities may form a subset. FIG. 3*c* schematically depicts an embodiment wherein the first subsets SS are configured upstream of the lens 315, and the second subset(s) AS are not. FIG. 3*d* schematically depicts the same embodiment as schematically depicted in FIG. 3*c*, but now with a diffuser 320 configured downstream of the second subset(s) AS. FIG. 3*e* schematically depicts an embodiment wherein the direction of the light is created by an optical element per LED (e.g. a lens plate). The sky may be created by wide-beam lenses (may be all identical) and the sun by narrow-beam optics (aimed at different directions.

Figure 4:
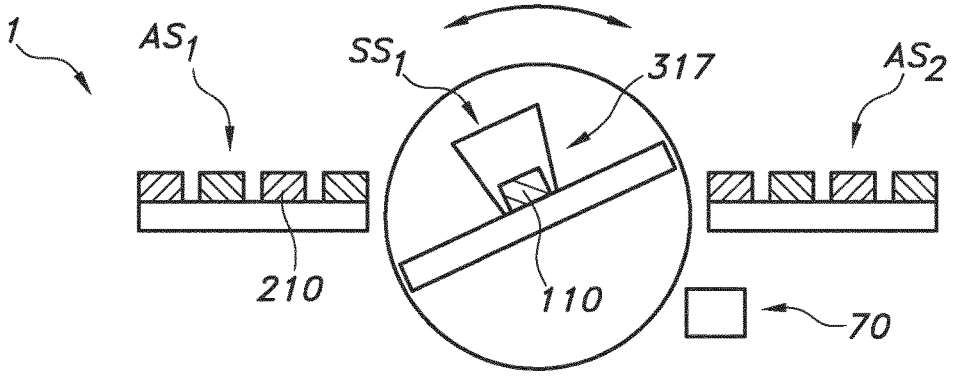
FIG. 4 schematically depicts a further lighting system as described herein.

FIG. 4 schematically depicts a lighting system wherein directionality or angular dependence of the intensity is created by one or more moveable elements. Here, a first subset is movable associated, here rotatable, with the lighting system. Alternatively or additionally, a plurality of movable (such as rotatable) first subsets are provided. Alternatively or additionally, a movable (such as rotatable) second subset is provided. Alternatively or additionally, a plurality of movable (such as rotatable) second subsets are provided. Embodiments described above may also apply to this lighting system. Reference 70 indicates an actuator configured to move the one or more first light sources 110. Movement may be such that an optical axis of the beam of light provided by light sources on the movable part is configured within a virtual cone with apex angle of equal to or less than 180°, especially less than 180°, such as about 135° or less. However, a user may in embodiments also choose a fixed setting of the first light source(s) 110 and the second light source(s) 210. Here, fixed setting may in embodiments refer to both optical properties of the light source(s) as well as the configuration of moveable elements such as movable light sources and/or movable optics.

The CCT of the sky may e.g. vary from cool white to blue, depending on whether the sky is clear or overcast. Typical ranges are:

| | |
|---|---|
| 6500-7500 K | Overcast sky |
| 9000-12000 K | Blue sky |

For the direct sunlight, the CCT depends on the time of day and the season. Typical values are

| | |
|---|---|
| 3200 K | Sunrise/sunset |
| 3400 K | 1 hour from dusk/dawn |
| 5500 K | Sunny daylight around noon |

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting system comprising a. at least two first subsets of first light sources configured to provide first light comprising two or more first light beams in at least two or more different first directions, wherein the two or more first light beams have a color selected from the group consisting of yellow, orange, red, and white with a first correlated color temperature;

b. one or more second subsets of one or more second light sources configured to provide second light comprising one or more second light beams in one or more second directions, wherein the one or more second light beams have a color selected from the group consisting of purple, violet, blue and white light having a second correlated color temperature, wherein one or more of the color and correlated color temperature of the first light is variable, wherein the intensity of the first light is variable, and wherein one or more of the color and correlated color temperature of the second light is variable, wherein the intensity of the second light is variable; wherein one or more of said first light and said second light have a variable directionality, and wherein the first light has a v' value of at least 0.47 according to CIE 1976 and wherein the second light has a lower v' value;

c. a control system configured to control one or more of intensities of the two or more first light beams and one or more of colors and first correlated color temperatures of the two or more first light beams, and configured to control one or more of one or more intensities of the one or more second light beams and one or more of colors and second correlated color temperatures of the one or more second light beams;

wherein the lighting system is configured to provide one or more of said first light having a variable angular distribution of one or more of intensity, color, and correlated color temperature, and said second light comprising one or more of said one or more second light beams.

2. The lighting system according to claim 1, wherein at least two first different directions and one or more second directions are configured within a virtual cone having an apex angle of smaller than 180° and a virtual cone axis, wherein the control system is configured to gradually shift the intensity of the first light from one side of the virtual cone axis to another side of the virtual cone axis by controlling the intensities of the two or more first light beams.

3. The lighting system according to claim 2, configured to provide a maximum angular shift of the first light, wherein the control system is configured to execute said maximum angular shift in at minimum 2 hours.

4. The lighting system according to claim 2, further comprising a third light source configured to provide a third light beam in a third direction different from the at least two or more different first directions and the one or more second directions, configured outside the virtual cone.

5. The lighting system according to claim 1, comprising at least two second subsets of second light sources configured to provide two or more second light beams in two or more second directions, thereby providing second light having a variable angular distribution of one or more of intensity, color, and correlated color temperature.

6. The lighting system according to claim 5, comprising 3-20 first subsets and 2-10 second subsets.

7. The lighting system according to claim 1, wherein the two or more first light beams have a white color light having first correlated color temperatures of less than 5500 K, wherein the first correlated color temperatures of at least two of the two or more first light beams differ by at least 500 K, and wherein optionally the one or more second light beam have a white light color having a second correlated color temperature of more than 6500 K.

8. The lighting system according to claim 1, wherein the first light has a v' value of at least 0.475 according to CIE 1976.

9. The lighting system according to claim 1, wherein a control system is configured to vary one or more of an angular distribution of the intensity of the first light, an angular distribution of one or more of the color and correlated color temperature of the first light, an angular distribution of the intensity of the second light, an angular distribution of one or more of the color and correlated color temperature of the second light, as function of one or more of time, a GPS signal, and daylight sensor input.

10. The lighting system according to claim 1, wherein the first light has a variable a correlated color temperature variable in at least a range of 3500-5000 K, wherein a control system is configured to gradually vary the correlated color temperature of the first light from a first minimum via a first maximum to a second minimum, with a minimum change of at least 500 K up and a minimum change of at least 500 K down.

11. The lighting system according to claim 1, wherein the second light has a variable a correlated color temperature variable in at least a range of 6500-8000 K, wherein a control system is configured to gradually change the correlated color temperature of the second light by controlling the correlated color temperature of the one or more second light beams.

12. The lighting system according to claim 1, wherein the one or more first light sources and the one or more second light sources comprise solid state light sources, and wherein the total number of solid state light sources is at maximum 5000.

13. The lighting system according to claim 1, further comprising one or more of a lens, configured downstream of one or more first light sources, configured downstream of one or more of the one or more second light source, or configured downstream of one or more first light sources and one or more of second light sources, and a diffuser, configured downstream of one or more first light sources, configured downstream of one or more of the one or more second light source, or configured downstream of one or more first light sources and one or more of second light sources.

14. Use of the lighting system according to claim 1 for mimicking a sky by providing one or more of first light and second light to a ceiling.

* * * * *